US008114262B2

(12) United States Patent
Kang et al.

(10) Patent No.: US 8,114,262 B2
(45) Date of Patent: Feb. 14, 2012

(54) THICKNESS DISTRIBUTION CONTROL FOR ELECTROPLATING

(75) Inventors: Gary Yih-Ming Kang, Fremont, CA (US); Yi-Shung Chaug, Cupertino, CA (US)

(73) Assignee: SiPix Imaging, Inc., Fremont, CA (US)

( * ) Notice: Subject to any disclaimer, the term of this patent is extended or adjusted under 35 U.S.C. 154(b) by 1107 days.

(21) Appl. No.: 11/621,890

(22) Filed: Jan. 10, 2007

(65) Prior Publication Data

US 2007/0175762 A1 Aug. 2, 2007

Related U.S. Application Data

(60) Provisional application No. 60/758,340, filed on Jan. 11, 2006.

(51) Int. Cl.
*C25D 21/12* (2006.01)

(52) U.S. Cl. ..... 205/84; 205/83; 205/96

(58) Field of Classification Search ..... 205/82, 205/83, 84, 96; 204/227.8, DIG. 7
See application file for complete search history.

(56) References Cited

U.S. PATENT DOCUMENTS 3,876,389 A * 4/1975 Chaudhari et al. ..... 428/608
4,304,641 A 12/1981 Grandia
4,659,446 A 4/1987 Shafer et al.
5,318,683 A 6/1994 Smith et al.
5,368,711 A * 11/1994 Poris ..... 204/193
5,776,327 A 7/1998 Botts et al.
6,004,440 A 12/1999 Hanson et al.
6,251,225 B1 6/2001 Ruf et al.
6,301,039 B1 * 10/2001 Tench ..... 359/267
6,929,723 B2 8/2005 Metzger
7,070,686 B2 * 7/2006 Contolini et al. ..... 205/96
7,160,421 B2 * 1/2007 Wilson et al. ..... 204/229.4
2006/0102467 A1 * 5/2006 Herchen et al. ..... 204/230.2
2006/0266653 A1 * 11/2006 Birang et al. ..... 205/83
2007/0068819 A1 * 3/2007 Singh et al. ..... 205/83

OTHER PUBLICATIONS

F. A. Lowenheim, Electroplating, McGraw-Hill Book Co., New York, 1978, pp. 12-13.*

Allen, K. (Oct. 2003). Electrophoretics Fulfilled. *Emerging Displays Review: Emerging Display Technologies, Monthly Report*-Oct. 9-14, 2003.

Bardsley, J.N. & Pinnel, M.R. (Nov. 2004) Microcup™ Electrophoretic Displays. *USDC Flexible Display Report*, 3.1.2. pp. 3-12-3-16.

Chaug, Y.S., Haubrich, J.E., Sereda, M. and Liang, R.C. (Apr. 2004). Roll-to-Roll Processes for the Manufacturing of Patterned Conductive Electrodes on Flexible Substrates. *Mat. Res. Soc. Symp. Proc.*, vol. 814,19.6.1.

Chen, S.M. (Jul. 2003) The Applications for the Revolutionary Electronic Paper Technology. *OPTO News & Letters*, 102, 37-41. (in Chinese, English abstract attached, full translation available upon request).

(Continued)

*Primary Examiner* — Alexa Neckel
*Assistant Examiner* — William Leader
(74) *Attorney, Agent, or Firm* — Perkins Coie LLP

(57) ABSTRACT

The invention is directed to an assembly for electroplating comprising an electroplating bath and non-conductive plates. The invention is also directed to an assembly for electroplating comprising an electroplating bath, elements with electrically adjustable resistance, and ampere-hour meters. The invention is further directed to methods for monitoring, controlling and adjusting the thickness distribution of an electroplated material on an object. The object can be of any shape as long as it can electrically charged.

3 Claims, 8 Drawing Sheets

OTHER PUBLICATIONS

Chen, S.M. (May 2003) The New Applications and the Dynamics of Companies. *TRI*. 1-10. (In Chinese, English abstract attached, full translation availabe upon request).

Chung, J., Hou, J., Wang, W., Chu, L.Y., Yao, W., & Liang, R.C. (Dec. 2003). Microcup(R) Electrophoretic Displays, Grayscale and Color Rendition. *IDW*, AMD2/EP1-2, 243-246.

Ho, Andrew. (Nov. 15, 2006) *Embedding e-Paper in Smart Cards, Pricing Labels & Indicators*. Presentation conducted at Smart Paper Conference Nov. 15-16, 2006, Atlanta, GA.

Ho, Candice. (Feb. 1, 2005) *Microcupt® Electronic Paper Device and Applicaiton*. Presentation conducted at USDC 4th Annual Flexible Display Conference 2005.

Ho, C.,& Liang, R.C. (Dec. 2003). *Microcup (R) Electronic Paper by Roll-to-Roll Manufacturing Processes*. Presentation conducted at FEG, Nei-Li, Taiwan.

Hou, J., Chen, Y., Li, Y., Weng, X., Li, H. And Pereira, C. (May 2004). Reliability and Performance of Flexible Electrophoretic Displays by Roll-to-Roll Manufacturing Processes. *SID Digest*, 32.3, 1066-1069.

Lee, H., & Liang, R.C. (Jun. 2003) SiPix Microcup(R) Electronic Paper—An Introduction. *Advanced Display*, Issue 37, 4-9 (in Chinese, English abstract attached, full translation available upon request).

Liang, R.C. (Feb. 2003) *Microcup(R) Electrophoretic and Liquid Crystal Displays by Roll-to-Roll Manufacturing Processes*. Presentation conducted at the Flexible Microelectronics & Displays Conference of U.S. Display Consortium, Phoenix, Arizona, USA.

Liang, R.C. (Apr. 2004). *Microcup Electronic Paper by Roll-to-Roll Manufacturing Process*. Presentation at the Flexible Displays & Electronics 2004 of Intertech, San Fransisco, California, USA.

Liang, R.C. (Oct. 2004) *Flexible and Roll-able Display/Electronic Paper—A Technology Overview*. Paper presented at the METS 2004 Conference in Taipie, Taiwan.

Liang, R.C., (Feb. 2005) *Flexible and Roll-able Displays/Electronic Paper—A Brief Technology Overview*. Flexible Display Forum, 2005, Taiwan.

Liang, R.C., Hou, J., Chung, J., Wang, X., Pereira, C., & Chen, Y. (2003). Microcup(R) Active and Passive Matrix Electrophoretic Displays by a Roll-to-Roll Manufacturing Processes. *SID Digest*, 20.1.

Liang, R.C., Hou, J., & Zang, H.M. (Dec. 2002) Microcup Electrophoretic Displays by Roll-to-Roll Manufacturing Processes. *IDW*, EP2-2, 1337-1340.

Liang, R.C., Hou, J., Zang, H.M., & Chung, J. (Feb. 2003). *Passive Matrix Microcup(R) Electrophoretic Displays*. Paper presented at the IDMC, Taipei, Taiwan.

Liang, R.C., Hou, J., Zang, H.M., Chung, J., & Tseng, S. (2003). Microcup(R) displays : Electronic Paper by Roll-to-Roll Manufacturing Processes. *Journal of the SID*, 11(4), 621-628.

Liang, R.C., Zang, H.M., Wang, X., Chung, J. & Lee, H., (Jun./Jul. 2004) "Format Flexible Microcup (R) Electronic Paper by Roll-to-Roll Manufacturing Process", Presentation conducted at the 14th FPD Manufacturing Technology EXPO & Conference.

Liang, R.C., & Tseng, S. (Feb. 2003). *Microcup(R) LCD, An New Type of Dispersed LCD by A Roll-to-Roll Manufacturing Process*. Paper presented at the IDMC, Taipei, Taiwan.

Nikkei Microdevices. (Dec. 2002) Newly-Developed Color Electronic Paper Promises—Unbeatable Production Efficiency. *Nikkei Microdevices*, 3. (in Japanese, with English translation).

Wang, X., Kiluk, S., Chang, C., & Liang, R.C. (Feb. 2004). Mirocup (R) Electronic Paper and the Converting Processes. *ASID*, 10.1.2-26, 396-399, Nanjing, China.

Wang, X., Kiluk, S., Chang, C., & Liang, R.C., (Jun. 2004) Microcup® Electronic Paper and the Converting Processes. *Advanced Display*, Issue 43, 48-51.

Wang, X., Li, P., Sodhi, D., Xu, T. and Bruner, S. et al., (Feb. 2006) *Inkjet Fabrication of Multi-Color Microcup® Electrophorectic Display*. The Flexible Microelectronics & Displays Conference of U.S. Display Consortium.

Wang, X., Zang, HM., and Li, P. (Jun. 2006) Roll-to-Roll Manufacturing Process for Full Color Electrophoretic film. *SID Digest*, pp. 1587-1589.

Zang, H.M. (Feb. 2004). *Microcup Electronic Paper*. Presentation conducted at the Displays & Microelectronics Conference of U.S. Display Consortium, Phoenix, Arizona, USA.

Zang, H.M. (Oct. 2003). *Microcup (R) Electronic Paper by Roll-to-Roll Manufacturing Processes*. Presentation conducted at the Advisory Board Meeting, Bowling Green State University, Ohio, USA.

Zang, H.M.Hou, Jack, (Feb. 2005) *Flexible Microcup® EPD by RTR Process*. Presentation conducted at 2nd Annual Paper-Like Displays Conference, Feb. 9-11, 2005, St. Pete Beach, Florida.

Zang, H.M, Hwang, J.J., Gu, H., Hou, J., Weng, X., Chen, Y., et al. (Jan. 2004). Threshold and Grayscale Stability of Microcup (R) Electronic Paper. *Proceeding of SPIE-IS&T Electronic Imaging, SPIE* vol. 5289, 102-108.

Zang, H.M., & Liang, R.C. (2003) Microcup Electronic Paper by Roll-to-Roll Manufacturing Processes. *The Spectrum*, 16(2), 16-21.

Zang, HM., Wang, W., Sun, C., Gu, H., and Chen, Y. (May 2006) Monochrome and Area Color Microcup® EPDs by Roll-to-Roll Manufacturing Processes. *ICIS '06 International Congress of Imaging Science Final Program and Proceedings*, pp. 362-365.

International Search Report for PCT/US2007/60408, mailed Jun. 19, 2008.

* cited by examiner

THICKNESS DISTRIBUTION CONTROL FOR ELECTROPLATING

This application claims priority to U.S. provisional application No. 60/758,340, filed Jan. 11, 2006. The content of which is incorporated herein by reference in its entirety.

BACKGROUND OF THE INVENTION

1. Field of the Invention

This invention is directed to assemblies and methods for monitoring in situ, controlling and adjusting the thickness distribution of an electroplated material on an object in an electroplating process. The object can be of any shape as long as it can be electrically charged.

2. Description of Related Art

U.S. Pat. No. 4,659,446 discloses cup-like shields of a non-conductive acid-resistant material that are secured at opposite ends of a cylinder for rotation with the cylinder and extend radially outwardly. The shields have a configuration such as to control the thickness of the metal deposited on the cylinder. However, the method has the disadvantage that cylinders of different diameters or lengths would need dedicated cup-like shields of different dimensions. Besides, the method can not monitor in-situ the distribution of the electroplated material.

U.S. Pat. No. 5,318,683 provides an electrodeposition apparatus and a method for reconditioning a gravure cylinder through electrodeposition. The apparatus includes a barrier member and a diffusion member that can prevent contaminants, e.g. soils and oxides, from moving into contact with the object being electroplated and also facilitate the dispersion of ions in the electroplating bath. The method disclosed, however, is not effective for controlling and adjusting the thickness distribution on the object because both the distribution of electrical field and deposition time along the cylinder's longitudinal axis are not controlled.

U.S. Pat. No. 6,929,723 discloses an apparatus for electroplating a rotogravure cylinder. The apparatus includes a non-dissolvable anode and an ultrasonic system that introduces wave energy into the plating solution. While the reference addresses several problems and quality issues in the electroplating of the rotogravure cylinder, the thickness distribution of the plated material cannot be controlled for the same reason as described for the method of U.S. Pat. No. 5,318,683.

Therefore there is still a need for methods to monitor, control and adjust the thickness distribution of an electroplated material in an electroplating process. A method which can monitor in situ the thickness distribution is particularly desirable.

SUMMARY OF THE INVENTION

The present invention is directed to assemblies and methods for monitoring in situ, controlling and adjusting the thickness distribution of an electroplated material in an electroplating process.

The first aspect of the present invention is directed to such a method involving the combination of position-adjustable non-conductive plates and ampere-hour meters to control the thickness distribution.

The second aspect of the present invention is directed to such a method involving the combination of rheostats (i.e., variable resistors) and ampere-hour meters to control the thickness distribution.

The methods of the present invention can be used to ensure desired thickness distribution of an electroplated material. In addition, the methods are applicable to not only metal or alloy electroplating, but also electroforming and composite electroplating.

DETAILED DESCRIPTION OF THE INVENTION

Figure 1:
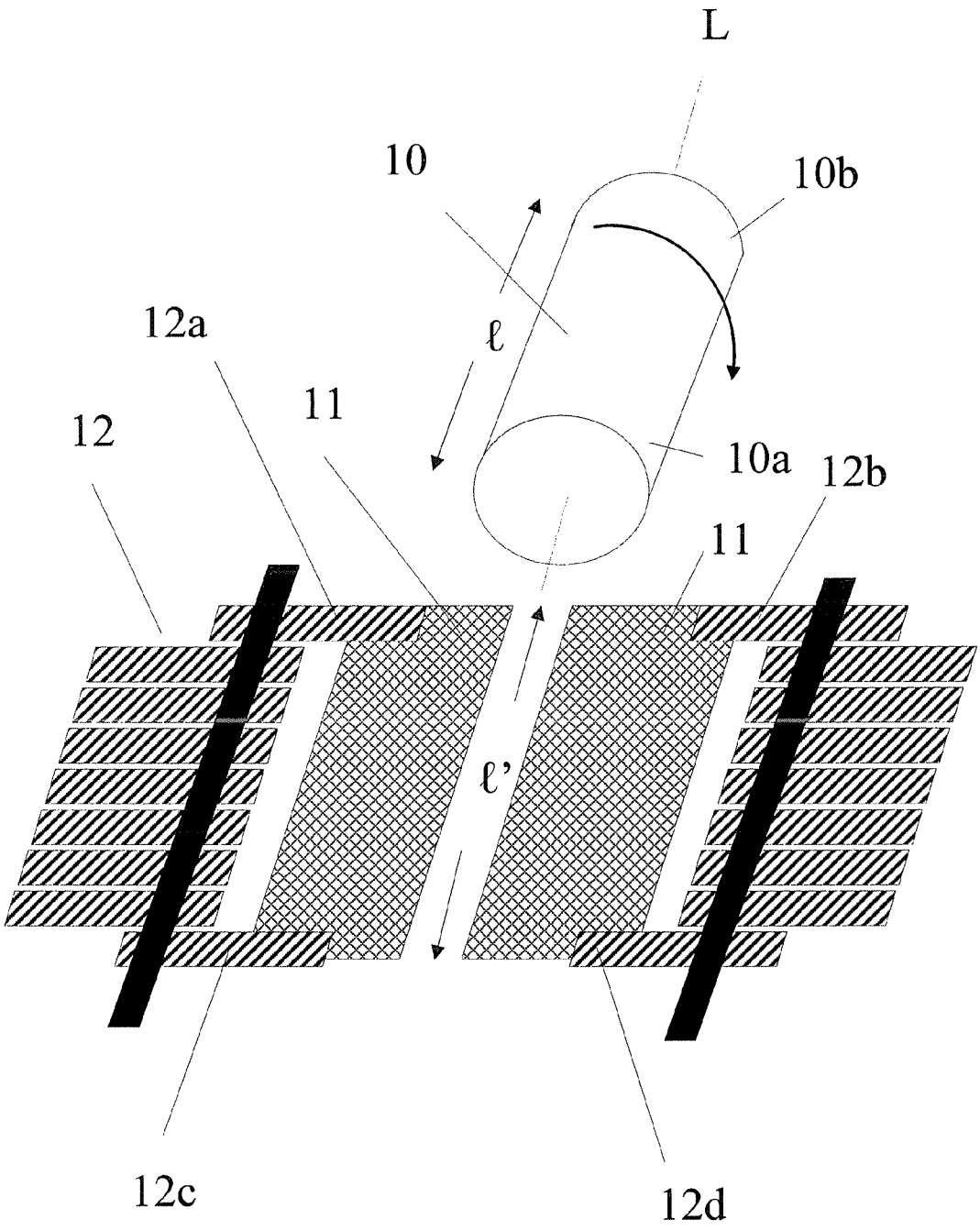
FIG. 1 depicts a method for adjusting the distribution of deposition thickness on a cylinder rotating axially (along the "L" axis) during an electroplating process.

This invention provides assemblies and methods to monitor in situ, control and adjust the thickness distribution of an electroplated material on an object in an electroplating process. The object can be of any shape as long as it can be electrically charged. A cylinder-shaped object that rotates axially is particularly suitable for the present invention.

During the process, the object to be electroplated is at lease partially immersed in an electroplating bath and rotates axially during electroplating. The layout of the object and anode (s) can be horizontal, vertical or tilted, although the horizontal layout may be preferred. For the horizontal layout, the object can be partially or completely immersed in an electroplating bath. In contrast, the object must be completely immersed in an electroplating bath for the vertical and tilted layouts.

The anode may be a non-dissolvable anode, dissolvable anode bar or plate. It may include a dissolvable metal or alloy pellets or chips in an anode basket that is immersed in the electroplating bath.

The material to be electroplated on the object can be a metal (e.g., aluminum, copper, zinc, nickel, chromium, iron, cobalt, gold, palladium, platinum, cadmium, indium, rhodium, ruthenium, silver, tin, lead or the like), an alloy derived from any of the aforementioned metals, or a composite material (e.g., fine particles of aluminum, silicon carbide or polytetrafluoroethylene (PTFE) or the like dispersed in a plated metal or alloy).

The present invention provides an assembly for electroplating, which assembly comprises: (a) an electroplating bath in which an object to be electroplated and multiple anodes are immersed wherein said object acts as a cathode; and (b) non-conductive plates placed between said object and said anode(s), wherein the position of said non-conductive plates is individually adjustable to control the area of coverage of said anodes. Optionally, the assembly comprises a controller which sends signals to adjust the position of each of said non-conductive plates. Optionally, the assembly further comprises ampere-hour meters through which the anodes are connected to the controller and a rectifier; preferably, the object is connected directly, or through a main ampere-hour meter, to the rectifier.

The present invention also provides an assembly for electroplating, which assembly comprises: (a) an electroplating bath in which an object to be electroplated and multiple anodes are immersed and said object acts as a cathode; (b) elements with electrically adjustable resistance which are individually and directly or indirectly connected to each of said anodes; and (c) ampere-hour meters which are individually connected to the elements with electrically adjustable resistance. In one embodiment, each of the elements is connected directly, or through an ampere-hour meter, to said anodes. In another embodiment, the element with electrically adjustable resistance is a rheostat or variable resistor.

The present invention provides a method for monitoring, controlling and adjusting the thickness distribution of an electroplated material on an object in an electroplating process, which method comprises: (a) immersing in an electroplating bath multiple anodes and an object to be electroplated and to act as a cathode; (b) providing non-conductive plates placed between said object and said anodes; and (c) adjusting individually the position of said non-conductive plates to control the area of coverage of said anodes. The step (c) may be carried out according to signals sent by a controller. In one embodiment, the controller compiles deposition data received from ampere-hour meters; preferably, each of said anodes is connected to an individual ampere-hour meter.

The present invention further provides a method for monitoring, controlling and adjusting the thickness distribution of an electroplated material on an object in an electroplating process, which method comprises: (a) immersing in an electroplating bath multiple anodes and an object to be electroplated and to act as a cathode; and (b) providing elements with electrically adjustable resistance which are individually connected to each of said anodes. In one embodiment, each of the elements with electrically adjustable resistance is individually connected to the anode through an ampere-hour meter or is located between said anode and an ampere-hour meter. In another embodiment, the element with electrically adjustable resistance is a rheostat or variable resistor. In yet another embodiment, the element with electrically adjustable resistance has electrical resistance which is adjusted according to signals sent by a controller; preferably, the controller compiles deposition data received from ampere-hour meters.

Figure 2:
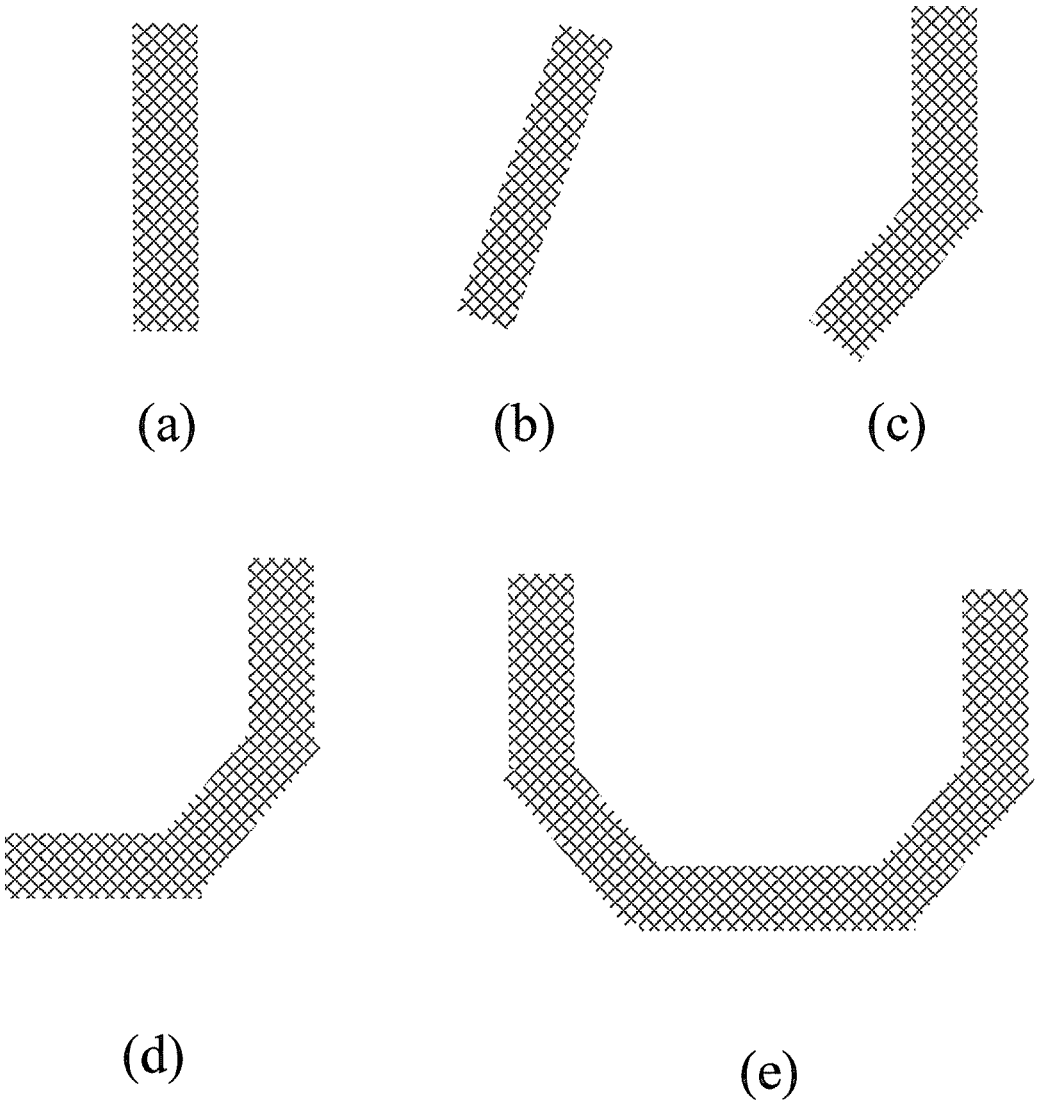
FIG. 2 shows different configurations of anodes.

FIG. 1 depicts an assembly and method for controlling and adjusting the distribution of deposition on a cylinder rotating axially (along the "L" axis) during an electroplating process. In the method, the cylinder (10) and anode(s) (11) are connected to rectifier(s) (not shown) to be negatively and positively charged, respectively. The anode may be of two pieces as shown in FIG. 1 or of only one piece. Normally, if an anode is of a shape as shown as type (a), (b), (c) or (d) in FIG. 2, two pieces of such an anode, each on the opposite sides of the cylinder as shown in FIG. 1 are preferred. However, if an anode has a shape as shown as type (e) which can flank both sides of the cylinder, one piece of such an anode would be sufficient.

The length (l') of the anode(s) should be at least the length (l) of the cylinder.

Because there is a higher electrical field or current density at each end (10*a* or 10*b*) of the cylinder immersed in a plating solution, the deposited material at the two ends of the cylinder is usually thicker than that at the middle of the cylinder, producing a "dog bone"-like deposition.

In FIG. 1, there are two sets of non-conductive plates (12) that are placed between the anodes and the cathode (i.e., the cylinder). Each set of the non-conductive plates has multiple non-conductive plates. The non-conductive plates may be flat, bended or curved, and they may overlap with each other. Also, depending on the layout of anode(s) and cathode (i.e., the cylinder), there may be only one set of non-conductive plates in the assembly. The non-conductive plates in each set are held together by a holding bar. The non-conductive plates may be formed of a material such as polyethylene, polypropylene, polyvinyl chloride, nylon, Teflon, neoprene or a derivative thereof. The position of each of the non-conductive plates may be adjusted to provide different degrees of coverage of the anode area. If a non-conductive plate is pushed in (towards the center of the diagram) causing more of the anode area to be covered by the non-conductive plate, the deposition rate on the cylinder facing that particular anode area would be decreased because of the shorter electroplating time as well as decreased current density.

Therefore in order to eliminate the "dog bone"-like deposition pattern on the cylinder, the non-conductive plates (12*a*-12*d*) facing the two ends of the cylinder are pushed in so as to cover more of the anode area whereas the non-conductive plates facing the middle part of the cylinder are kept apart so as to cover less or none of the anode area, as shown in FIG. 1. As a result, the electroplated material may be more evenly distributed on the surface of the cylinder.

While it is shown in FIG. 1 that only four non-conductive plates (12*a*-12*b*) have been moved to an inward position and the rest of the non-conductive plates remain at the original position, it is understood that each of the non-conductive plates may be moved to a different position, depending on the targeted (or desired) thickness distribution at a particular area on the surface of the cylinder.

Figure 3:
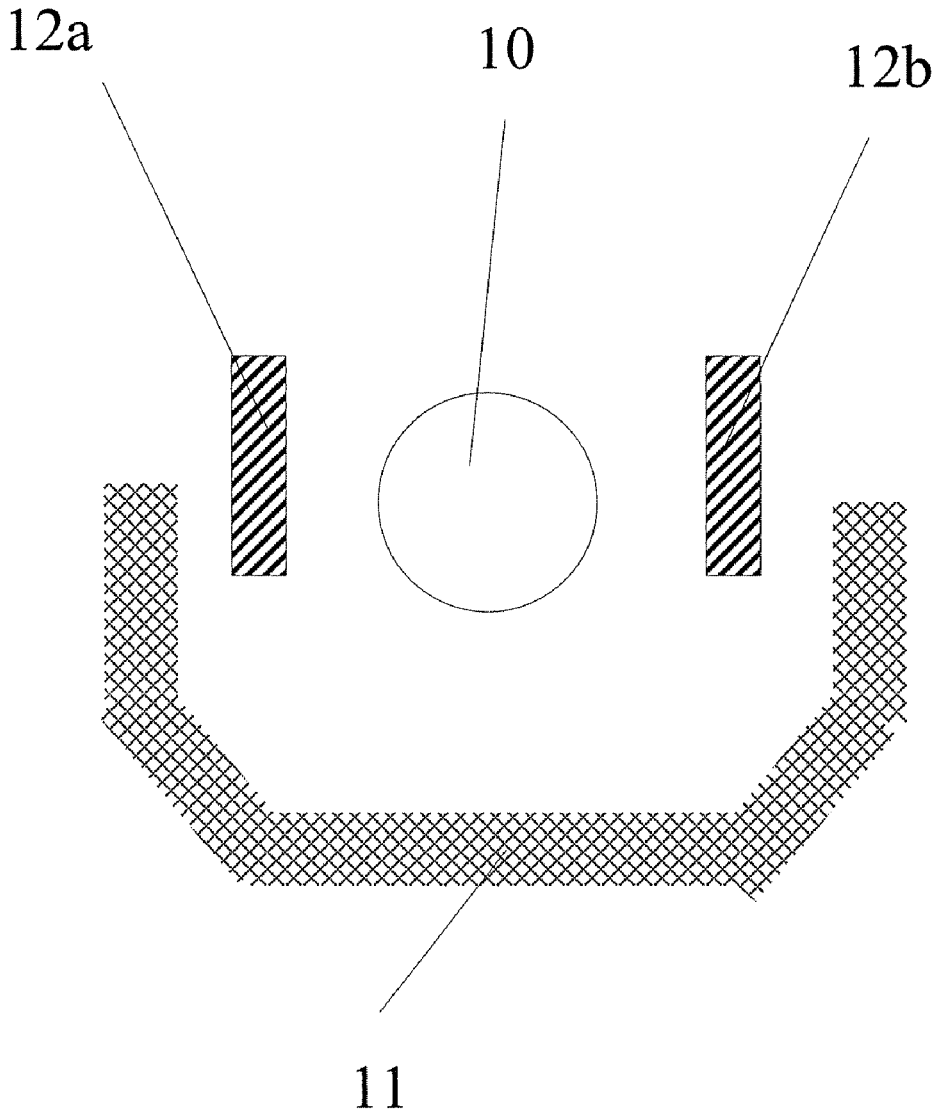
FIG. 3 is a cross section view of an electroplating assembly.

FIG. 3 is a cross-section view of an electroplating assembly as discussed above. The anode (11), in this case, is shown as curved. The two non-conductive plates are the two non-conductive plates 12*a* and 12*b* in FIG. 1.

Figure 4:
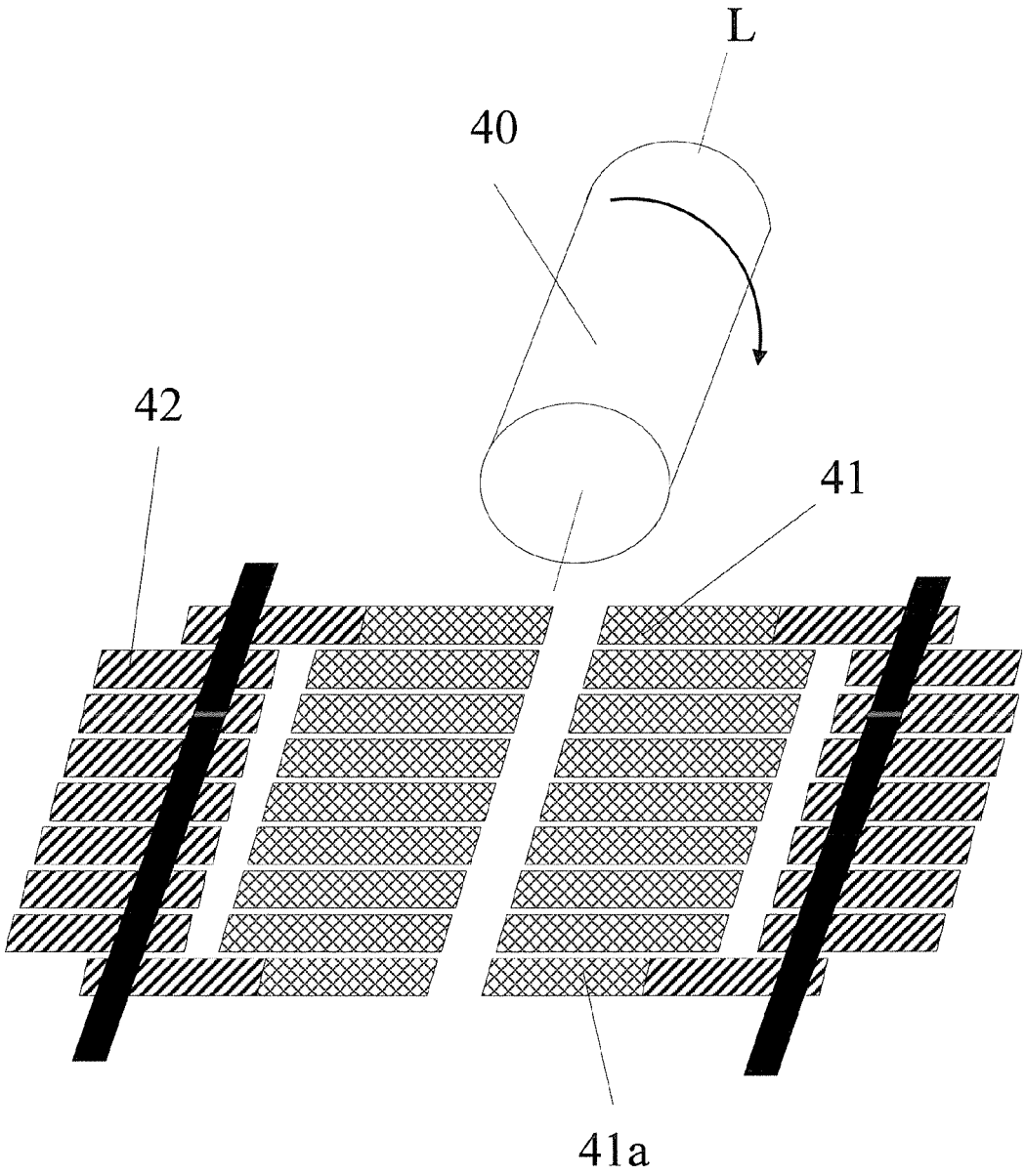
FIG. 4 depicts a further improved electroplating assembly in which the thickness distribution of the electroplated material may be monitored in situ.

FIG. 4 depicts an improved electroplating assembly in which the thickness distribution of the electroplated material may be monitored in situ.

In this improved system, the set-up is similar to that of FIG. 1, except that the anodes (41) are divided into multiple smaller pieces (41*a*). In this case, each of the smaller sized anodes (41*a*) is hung or fixed onto a non-conductive bar (not shown) and they are not physically in contact with each other.

Figure 5:
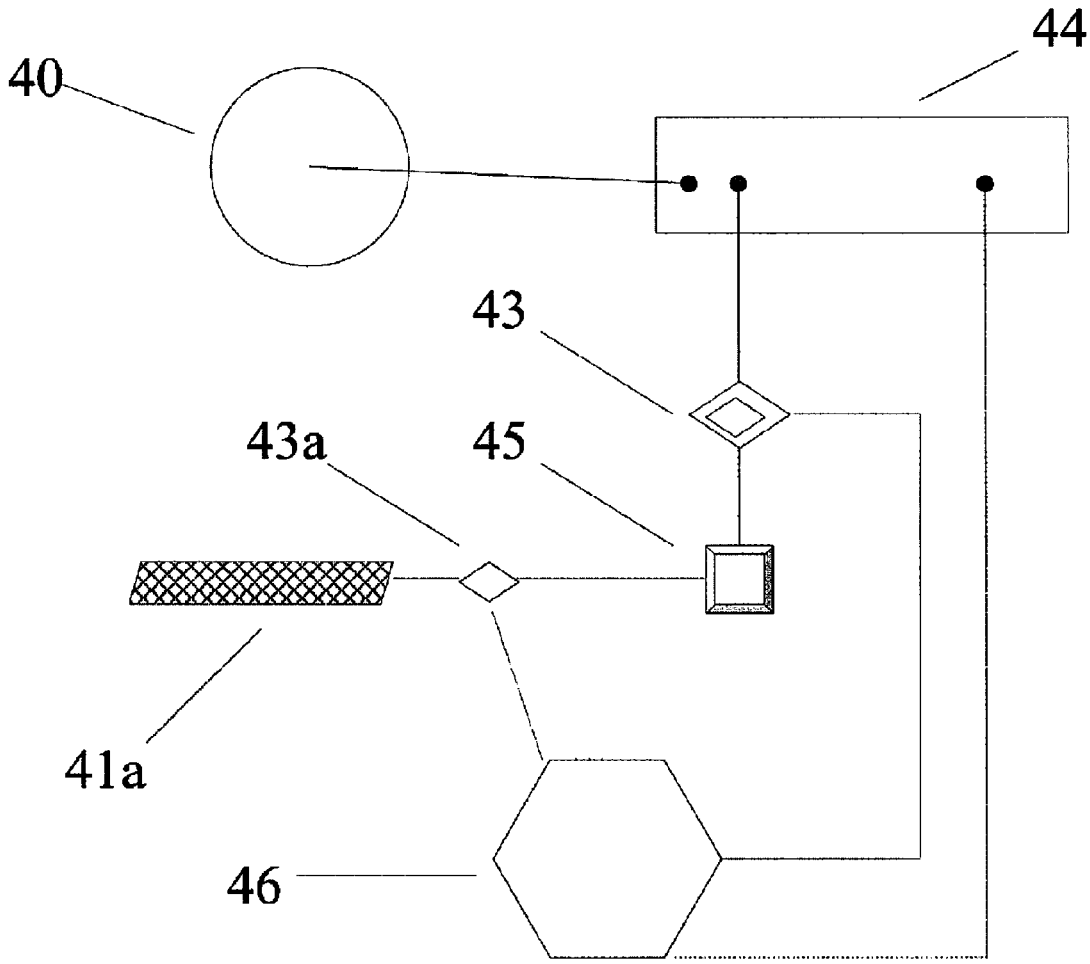
FIG. 5 illustrates how the components of the assembly as shown in FIG. 4 are connected.

FIG. 5 illustrates how the components of the assembly are connected. The cylinder (i.e., the cathode) (40) is connected to the negative terminal of a rectifier (44) and in turn the positive terminal of the rectifier (44) is connected to each of smaller sized anodes (41*a*) through an optional main ampere-hour meter (43), an optional electrical hub (45) and an ampere-hour meter (43*a*). The main ampere-hour meter (43), if present, measures and records the total deposition and average thickness of the electroplated material on the surface of the cylinder. Alternatively, the main ampere-hour meter (43), if present, can be located between the rectifier (44) and the cylinder (40). Each of the smaller sized anodes (41*a*) is connected to an ampere-hour meter (43*a*) which measures and records the deposition and thickness of the electroplated material in an area on the cylinder which faces that particular smaller sized anode. For brevity, only one smaller sized anode is shown in the diagram; however, it is understood that each of the smaller sized anodes is similarly connected to an individual ampere-hour meter (43*a*).

Figure 6:
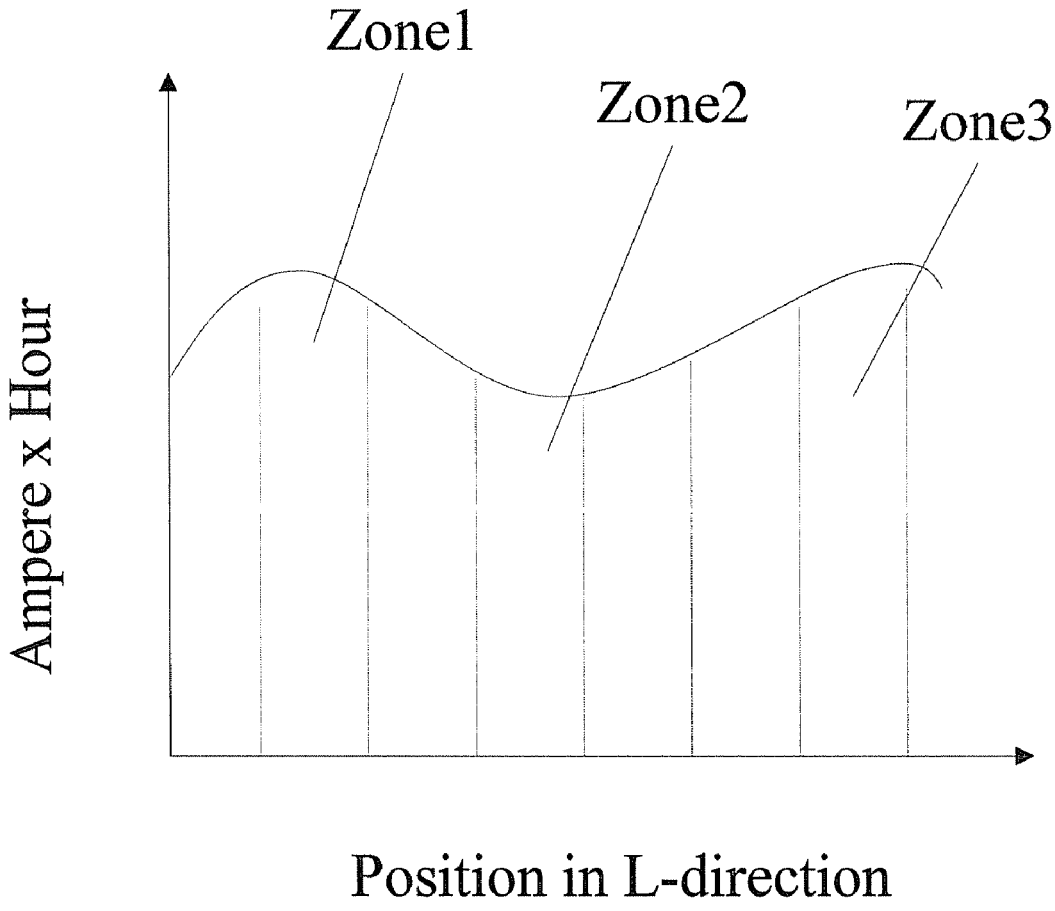
FIG. 6 shows a sample monitoring chart.
Figure 7:
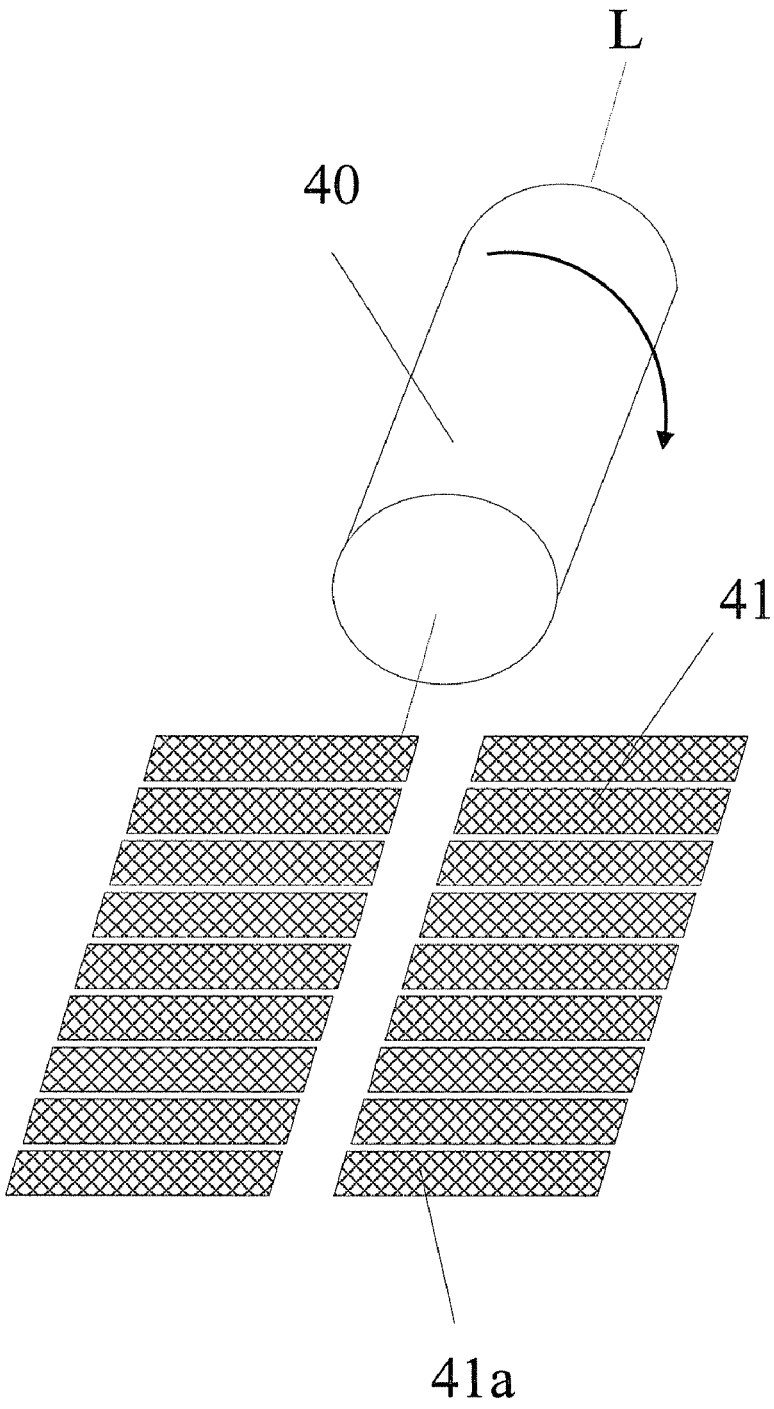
FIG. 7 depicts an alternative electroplating assembly with in situ monitoring.

During electroplating, the data from all of the ampere-hour meters are continuously updated and compiled in a controller (46) which in turn generates a monitoring chart as shown in FIG. 6. The value of ampere-hour is proportional to the deposition thickness. By using the monitoring chart, the thickness uniformity over the entire surface of the cylinder can be monitored in situ. If any adjustment of the thickness is necessary during electroplating, the positions of non-conductive plates (42) in FIG. 4 can be adjusted as described above, manually or automatically, to achieve the desired results. For automatic position adjustment of the non-conductive plates, every non-conductive plate is connected to a mechanical mean (not shown), e.g., a mini-motor. During electroplating, the controller (46), based on the difference between the desired thickness distribution and what is shown on the monitoring chart, may send signals to the mini-motors which in turn may individually move the non-conductive plates inward or outward accordingly to provide more or less coverage of the anode area.

Figure 8:
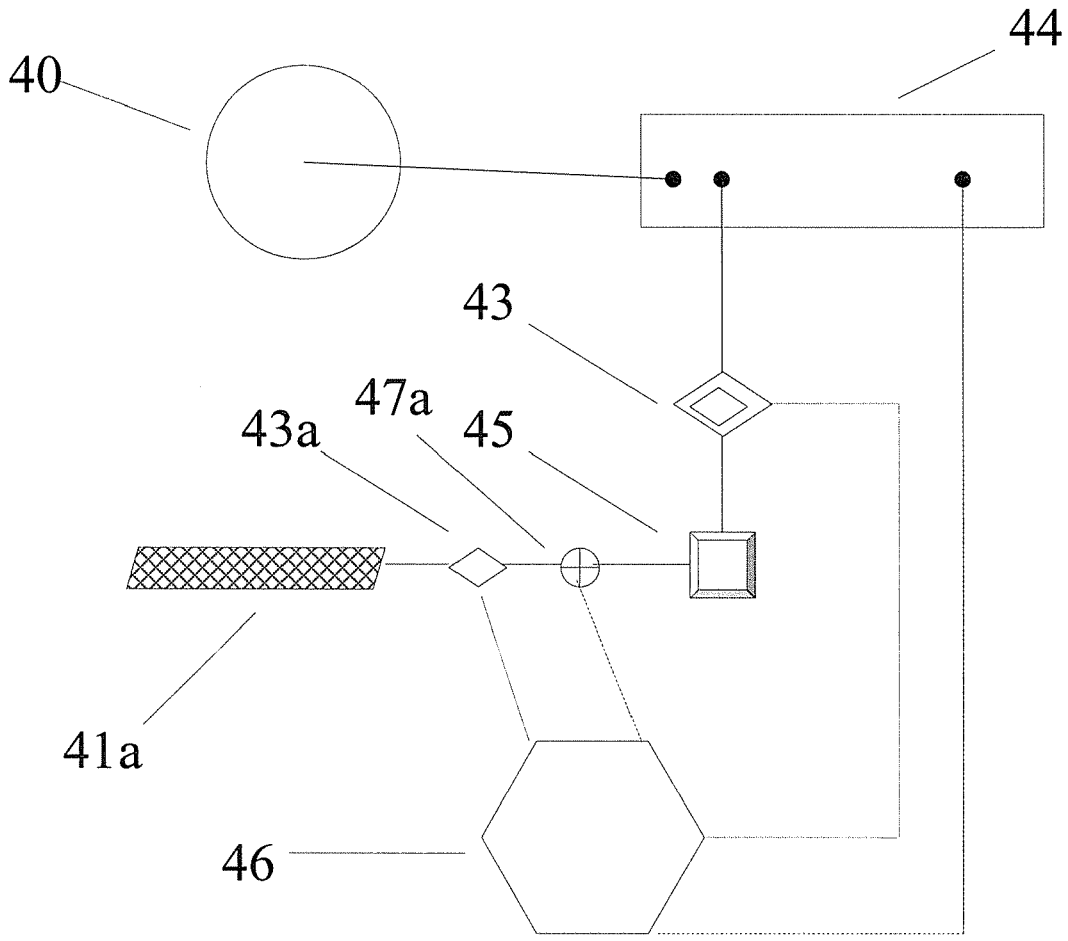
FIG. 8 illustrates how the components of the assembly as shown in FIG. 7 are connected.

FIG. 8 shows a further assembly and method to monitor in situ, control and adjust the deposition rate and thickness of the electroplated material on an object. Non-conductive plates are not necessary in this alternative method. Instead, an element with electrically adjustable resistance (e.g., rheostat or variable resistor, 47*a*) is electrically connected to each of the ampere-hour meters (43*a*). The element with electrically adjustable resistance is located between the ampere-hour meter (43*a*) and the optional electrical hub (45), as shown in FIG. 8, or alternatively it may be located between the ampere-hour meter (43*a*) and the anode (41*a*) (not shown). Further alternatively, the element with adjustable resistance (47*a*) may be contained in the ampere-hour meter. During electroplating, the thickness in different areas on the cylinder is continuously updated and recorded in the controller (46) which receives data from all ampere-hour meters. Based on the difference between the compiled data (i.e., the monitoring chart) and the desired thickness distribution, the controller sends a signal of increasing electrical resistance to the rheostat corresponding to an area where the deposition thickness is too high or sends a signal of decreasing electrical resistance to the rheostat corresponding to an area where the deposition thickness is too low. The thickness distribution is accordingly adjusted to achieve the desired results. The main ampere-hour meter (43) in FIG. 8 is also optional and may be located between the cylinder (40) and the rectifier (44).

Although the foregoing invention has been described in some detail for purposes of clarity of understanding, it will be apparent that certain changes and modifications may be practiced within the scope of the appended claims. It should be noted that there are many alternative ways of implementing both the process and apparatus of the present invention. Accordingly, the present embodiments are to be considered as illustrative and not restrictive, and the invention is not to be limited to the details given herein, but may be modified within the scope and equivalents of the appended claims.

What is claimed is:

1. A method for monitoring, controlling and adjusting the thickness distribution of an electroplated material on an object in an electroplating process, which method comprises:

a) immersing in an electroplating bath multiple anodes and an object to be electroplated and to act as a cathode;

b) providing (i) elements with electrically adjustable resistance, (ii) ampere-hour meters each of which is in serial connection with one of said anodes and one of said elements with electrically adjustable resistance, wherein each of said ampere-hour meters measures and records the deposition and thickness of the electroplated material in an area on the object which faces the anode to which said ampere-hour meter is connected; and (iii) a controller connected to said elements with electrically adjustable resistance and said ampere-hour meters;

c) providing compiled deposition data by the ampere-hour meters to the controller; and d) sending signals from the controller to the elements with electrically adjustable resistance based on the difference between the compiled data and the desired thickness distribution, to monitor, control, and adjust the thickness distribution of the electroplated material on the object.

2. The method of claim 1 wherein each of said elements with electrically adjustable resistance is located between one of said anodes and one of said ampere-hour meters.

3. The method of claim 1 wherein said element with electrically adjustable resistance is a rheostat or variable resistor.

* * * * *